United States Patent [19]

Corbin, Jr. et al.

[11] Patent Number: 4,854,771

[45] Date of Patent: Aug. 8, 1989

[54] METHOD OF INSTALLING PREFORMED PAVEMENT MATERIALS INTO ASPHALT SURFACES

[76] Inventors: Maxwell H. Corbin, Jr., 6234 Deeside Dr., Dublin, Ohio 43017; Peter D. Butler, 2063 W. Lane Ave., Columbus, Ohio 43221

[21] Appl. No.: 191,665

[22] Filed: May 9, 1988

[51] Int. Cl.[4] ..... E01C 7/06

[52] U.S. Cl. ..... 404/79; 404/73; 404/94; 404/95; 156/71; 156/273.3; 156/303.1

[58] Field of Search ..... 404/93, 79, 77, 73, 404/71, 94, 95; 156/71, 575, 577, 273.3, 303.1

[56] References Cited

U.S. PATENT DOCUMENTS

| | | | |
|---|---|---|---|
| 2,237,152 | 4/1941 | Larmour | 156/303.1 |
| 2,438,764 | 3/1948 | Phillips | 404/93 |
| 3,007,838 | 11/1961 | Eigenmann | 156/577 |
| 3,410,185 | 11/1968 | Harrington | 404/77 |
| 3,843,438 | 10/1974 | Gabriel | 156/303.1 |
| 4,792,259 | 12/1988 | Eigenmann | 404/73 |

*Primary Examiner*—Jerome Massie IV
*Assistant Examiner*—Gay Ann Spahn
*Attorney, Agent, or Firm*—John L. Gray

[57] ABSTRACT

A method of installing preformed pavement marking materials on an asphalt surface involving using infrared heat to raise the temperature of the surface so that the asphalt is sufficiently softened so that preformed pavement marking materials may be pressed into said asphalt surface.

4 Claims, No Drawings

METHOD OF INSTALLING PREFORMED PAVEMENT MATERIALS INTO ASPHALT SURFACES

BACKGROUND OF THE INVENTION

Thermoplastic pavement marking materials have become the most widely used durable pavement markings on asphalt pavements such as asphalt roads. Preformed thermoplastic marking materials are much superior to painted marking materials since their service life is as long as the asphalt surface. These marking materials conventionally are colored thermoplastic materials, usually about 0.025 to 0.125 inches thick, normally white or yellow in color, and are used to define traffic control information, such as pedestrian walkways, the stop line for automobiles and signals for right and left turn lanes.

Such preformed marking materials are installed by two basic processes. In the case of an existing roadway or, in some cases, even in connection with a roadway that is being installed, the preformed pavement marking material is applied to the asphalt surface by means of an adhesive.

There are many problems presented by this method. The preformed pavement marking material cannot be installed when the ambient temperature is below 60° F. or if the pavement temperature is below 60° F. Such marking material cannot be installed within 24 hours of a rainfall or if the pavement surface shows any indication of moisture. When the ambient temperature drops below 40° F. during the night after the material is installed, condensation will occur under the material which will loosen the adhesive bond of the preformed material to the pavement.

In high traffic areas there will be a concentration of oil or road film which will make the surface preparation very difficult and time consuming.

In addition, when existing pavement markings are to be removed, an extremely dusty and dirty condition is created in the area to receive the new overlay markings. All loose materials, adhesive, etc. must be removed before the new markings are installed.

In the case of new asphalt surfacing, the accepted practice is to apply the preformed pavement marking material as a part of the final surface preparation of the asphalt roadway. The advantage of inlaying the material in this fashio results in a much greater useful life of the material.

The basic problem in installing preformed pavement marking materials during the road construction is the coordination between the work crews that are installing the roadway and the work crews that are attempting to install the markings. It is extremely difficult to coordinate this activity and there is a very limited period of time as the asphalt cools down when the markings can be installed and this usually is about the same time that the finish pass of the asphalt roller is being made so that it is a very difficult task to accomplish.

SUMMARY OF THE INVENTION

Applicant's invention enables preformed pavement marking material to be installed on existing roadways or on recently resurfaced roadways when the work crews have left the scene. Applicant's invention involves heating the surface of the asphalt roadway in which the preformed pavement marking material is to be installed up to a temperature that will permit the preformed pavement marking material to be inlaid into the surface of the road and to such a temperature that the asphalt binders are reactivated and softened thus absorbing any surface dust and oils on the roadway and thus providing favorable conditions for the inlay of the material. Also by heating up the surface of the roadway, all moisture will be evaporated from the pavement so that condensation will not take place if the nighttime temperature drops below 40° F.

Furthermore, the applicationof preformed material can begin after a rainfall as soon as the surface water has run off the pavement.

It is therefore an object of this invention to provide a method whereby preformed pavement marking material may be installed on existing asphalt surfaces.

It is another object of this invention to provide a method of installing preformed pavement marking material on recently resurfaced asphalt surfaces.

It is still another object of this invention to provide a process of installing preformed pavement marking materials on asphalt surfaces in the early spring and late fall when the nighttime ambient temperature would otherwise be so low so as not to permit conventional adhesive attachment methods to be used.

These, together with other objects and advantages of the invention will become more readily apparent to those skilled in the art from the following detailed description.

DETAILED DESCRIPTION OF THE INVENTION

In practicing the method of the instant invention the surface of the pavement is heated by means of portable infrared heaters to a temperature which is sufficient so that the preformed pavement marking material may be pressed into the area of the pavement being heated. Usually the pavement is heated to a temperature between approximately 150° F. and 300° F. By warming the asphalt pavement to this temperature, the asphalt binders are reactivated and softened, thus conditioning the surface of the roadway by the absorption of surface dust and oils by the binders to favorably receive the inlay material. By heating the asphalt up to this temperature with infrared heaters, any moisture is driven from the pavement so that in the event that the temperature drops after the inlay is installed there will not be any condensation under the preformed pavement marking inlay.

It is important to use an infrared-type of heater. The conventional gas jet heaters that are used in connection with roadway work for certain procedures are not satisfactory for this purpose because they will destroy the volatile oils and binders in the asphalt at the necessary temperatures involved.

While the temperature of the pavement should be raised to from 150° F. to 300° F., the application temperature is usually from about 120° F. to 150° F. It is necessary to raise the asphalt temperature to a higher temperature because after the infrared heaters are removed and the preformed pavement marking material is positioned and then the roller is rolled over the preformed pavement marking material, the asphalt surface temperature, of course, will drop depending upon the ambient temperature and the other conditions existing at the time.

After the area of the asphalt surface that is destined to receive the preformed pavement marking material is heated to an appropriate temperature, the preformed pavement marking material is positioned on the asphalt surface and an asphalt roller of a minimum weight of one ton is rolled over the preformed pavement marking material in order to press the preformed pavement marking material into the asphalt surface.

By using this method it is possible to install the preformed pavement marking material on existing roadways, on recently completed roadways without any interference with the roadway construction crews, and throughout a much more extended period of time during the year except in the very cold winter months.

While this method has particular application to asphalt surface roadways where preformed pavement marking materials are used because of the high traffic conditions, it may also be used on other asphalt surfaces such as parking lots.

While this invention has been described in its preferred embodiment, it is to be appreciated that variations therefrom may be made without departing from the true scope and spirit of the invention.

What is claimed is:

1. A method of installing preformed pavement marking material on an asphalt surface which comprises exposing the area of said asphalt surface which is to receive said preformed pavement marking material to a source of infrared radiation at an energy level and for a sufficient period of time to raise the temperature of said area of said asphalt surface to a temperature sufficient to soften said area of said asphalt surface to an extent such that said preformed pavement marking material may be pressed into said area of said softened asphalt surface to a depth of approximately 50 percent to 75 percent of the thickness of said preformed pavement marking material, removing said source of infrared radiation, and then pressing said preformed pavement marking material into said softened asphalt surface to a depth of approximately 50 percent to 75 percent of the thickness of said preformed pavement marking material.

2. The method of claim 1 wherein said area of said asphalt surface which is to receive said preformed marking material is raised to a temperature of from approximately 150° F. to 300° F.

3. The method of claim 1 wherein said preformed pavement marking material is pressed into said area of said softened asphalt surface by means of a roller.

4. The method of claim 1 wherein said preformed pavement marking material is pressed into said area of said softened asphalt surface when said softened asphalt surface is at a temperature of 120° F. to 150° F.

* * * * *